US011021299B2

(12) United States Patent
Lin

(10) Patent No.: US 11,021,299 B2
(45) Date of Patent: Jun. 1, 2021

(54) CAPPING STRUCTURE AND CONTAINER HAVING THE SAME

(71) Applicant: LIBO COSMETICS CO., LTD., Changhua County (TW)

(72) Inventor: Hsiao-Yun Lin, Changhua County (TW)

(73) Assignee: Libo Cosmetics Co., Ltd., Changhua County (TW)

( * ) Notice: Subject to any disclaimer, the term of this patent is extended or adjusted under 35 U.S.C. 154(b) by 92 days.

(21) Appl. No.: 16/363,027

(22) Filed: Mar. 25, 2019

(65) Prior Publication Data

US 2019/0300241 A1 Oct. 3, 2019

(30) Foreign Application Priority Data

Apr. 2, 2018 (CN) ..... 201820455932.9

(51) Int. Cl.

| | |
|---|---|
| ***B65D 55/00*** | (2006.01) |
| ***B65D 41/16*** | (2006.01) |
| ***B65D 41/04*** | (2006.01) |
| ***B65D 25/54*** | (2006.01) |
| ***A45D 40/00*** | (2006.01) |

(52) U.S. Cl.

CPC ..... *B65D 25/54* (2013.01); *B65D 41/04* (2013.01); *B65D 41/16* (2013.01); *B65D 55/00* (2013.01); *A45D 2040/0012* (2013.01)

(58) Field of Classification Search

CPC ..... B65D 25/54; B65D 55/00; B65D 41/16; B65D 41/04; B65D 41/165; B65D 41/18; B65D 41/0407; A45D 2040/0012; A45D 40/00; A45D 2040/0006; A45D 2040/0025

USPC ..... 215/228, 273, 274, 277; 220/212, 254.1, 220/256.1, 377

See application file for complete search history.

(56) References Cited

U.S. PATENT DOCUMENTS

| | | | | |
|---|---|---|---|---|
| 1,832,669 A * | 11/1931 | Thomas | ..... | B65D 41/20 215/332 |
| 4,747,500 A * | 5/1988 | Gach | ..... | B65D 55/02 215/250 |
| 5,715,961 A * | 2/1998 | Robertson | ..... | A45D 40/00 132/318 |
| 8,813,991 B1 * | 8/2014 | Liu | ..... | B65D 43/0212 220/378 |

* cited by examiner

*Primary Examiner* — David J Walczak

(74) *Attorney, Agent, or Firm* — Muncy, Geissler, Olds & Lowe, P.C.

(57) ABSTRACT

A capping structure includes a tubular shell and a cap window. The cap window is transparent and engages with an inner sidewall of the tubular shell. The cap window includes a cover and a brace. The cover is disposed at an opening of the tubular shell, and the brace protrudes from the cover and has at least a surface being parallel to the inner sidewall of the tubular shell.

20 Claims, 12 Drawing Sheets

CAPPING STRUCTURE AND CONTAINER HAVING THE SAME

PRIORITY CLAIM AND CROSS-REFERENCE

This application claims priority of China application No. 201820455932.9 filed on Apr. 2, 2018, which is incorporated herein by reference in its entirety.

TECHNICAL FIELD

The present disclosure relates to a capping structure and a container, and more particularly, to a capping structure with a window to see through.

DISCUSSION OF THE BACKGROUND

Various containers and types of outer packaging have been introduced to the market in large quantities. A general purpose of a container is to protect contents contained in the container. However, as market competition increases, various features of luxury, beauty, color and quality of outward appearance of a container have become important in attracting consumer attention and enhancing sales.

To achieve desired functions, e.g. good outward appearance, good quality, long service life and good protection of the contents, material and manufacturing costs of a container have increased. In addition, a high quality and beautiful container or packing is conventionally made of metal or glossy colored material, for example, and customers need to open a container every time they want to check the product or contents inside the container.

This Background section is provided for background information only. The statements in this Background are not an admission that the subject matter disclosed in this section constitutes prior art to the present disclosure, and no part of this Background section may be used as an admission that any part of this application, including this Background section, constitutes prior art to the present disclosure.

SUMMARY

One aspect of the present disclosure provides a capping structure including a tubular shell and a cap window. The cap window is transparent and engaged with an inner sidewall of the tubular shell. The cap window includes a cover and a brace. The cover is disposed at an opening of the tubular shell, and the brace protrudes from the cover and has at least a surface being parallel to the inner sidewall of the tubular shell.

In some embodiments, the cap window is engaged with the tubular shell by friction between the brace of the cap window and the inner sidewall of the tubular shell.

In some embodiments, the tubular shell is made of fibrous material.

In some embodiments, material of the tubular shell includes at least one of paper, wood fiber, cellulose fibers, wood pulp, straw pulp, hemp pulp, mash pulp, sugar cane pulp, bamboo pulp, and rag pulp.

In some embodiments, the sidewall has a circular configuration extending from the first opening toward a second opening of the tubular shell and along the inner sidewall of the tubular shell, and the second opening is opposite to the first opening.

In some embodiments, the tubular shell has a curved end at the first opening of the tubular shell.

In some embodiments, the curved end is folded inward to form the first opening with a radius smaller than a radius of the second opening.

In some embodiments, the cover of the cap window is disposed at the first opening inside the tubular shell and against the curved end of the tubular shell.

In some embodiments, the brace of the cap window has a first length along the inner sidewall of the tubular shell, the inner sidewall of the tubular shell has a second length parallel to the first length, and the second length is greater than the first length.

In some embodiments, a ratio of a length of the brace to a width of the cover from a cross-section perspective is greater than 0.1.

Another aspect of the present disclosure provides a container for medicine, edible products, or cosmetic products. The container includes a tubular shell, a holder, and a cap window. The tubular shell has a first opening and a second opening, wherein the first opening is opposite to the second opening; the holder is engaged with an inner sidewall of the tubular shell from the second opening; and the cap window is engaged with the inner sidewall at the first opening of the tubular shell. The cap window is transparent and includes a cover and a brace. The cover is disposed at the first opening of the tubular shell, and the brace protrudes from the cover and has at least a surface being parallel to the inner sidewall of the tubular shell.

In some embodiments, the holder includes a base disposed outside the tubular shell and a body connected to the base and disposed inside the tubular shell.

In some embodiments, the container is a lipstick container, and the base and the body are rotated in different directions to push up or pull down a lipstick.

In some embodiments, the cap window is engaged with the tubular shell by friction between the brace of the cap window and the inner sidewall of the tubular shell.

In some embodiments, the tubular shell is made of paper.

In some embodiments, the cap window is made from at least one of polyamides (PA, or nylons), polycarbonate (PC), polyester (PES), polyethylene (PE), high-density polyethylene (HDPE), low-density polyethylene (LDPE), polyethylene terephthalate (PET), polypropylene (PP), polystyrene (PS), polyurethanes (PU), polyvinyl chloride (PVC), polyvinylidene chloride (PVDC), polyethylene terephthalate modified glycol (PETG), polycyclohexane dimethyl terephthalate modified by glycol (PCTG), polylactide (PLA), crystallized polylactic acid (CPLA), post-consumer recycled plastic (PCR), and acrylonitrile butadiene styrene (ABS).

In some embodiments, the sidewall has a circular configuration protruding from a peripheral region of the cover extending from the first opening toward the second opening of the tubular shell and along the inner sidewall of the tubular shell.

In some embodiments, an end of the tubular shell is folded toward the inner sidewall to form the first opening.

In some embodiments, the cover of the cap window is disposed at the first opening inside the tubular shell and against a curved end of the tubular shell.

In some embodiments, a radius of the first opening is smaller than that of the second opening.

The foregoing has outlined rather broadly the features and technical advantages of the present disclosure in order that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes as those of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

The following description of the present disclosure accompanies drawings, which are incorporated in and constitute a cosmetic case of this specification, and illustrate embodiments of the disclosure, but the disclosure is not limited to the embodiments. In addition, the following embodiments can be properly integrated to complete another embodiment.

References to "one embodiment," "an embodiment," "exemplary embodiment," "some embodiments," "other embodiments," "another embodiment," etc. indicate that the embodiment(s) of the disclosure so described may include a particular feature, structure, or characteristic, but not every embodiment necessarily includes the particular feature, structure, or characteristic. Further, repeated use of the phrase "in the embodiment" does not necessarily refer to the same embodiment, although it may.

In order to make the present disclosure completely comprehensible, detailed steps and structures are provided in the following description. Obviously, implementation of the present disclosure does not limit special details known by persons skilled in the art. In addition, known structures and steps are not described in detail, so as not to limit the present disclosure unnecessarily. Preferred embodiments of the present disclosure will be described below in detail. However, in addition to the detailed description, the present disclosure may also be widely implemented in other embodiments. The scope of the present disclosure is not limited to the detailed description, and is defined by the claims.

Figure 1:
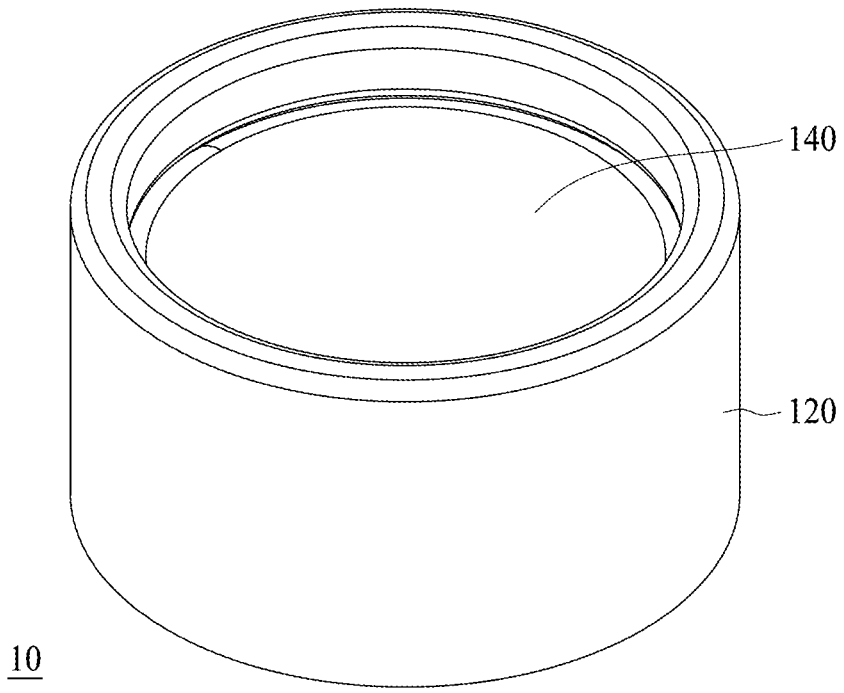
FIG. 1 is an assembled side view of a capping structure in accordance with some embodiments of the present disclosure.
Figure 2:
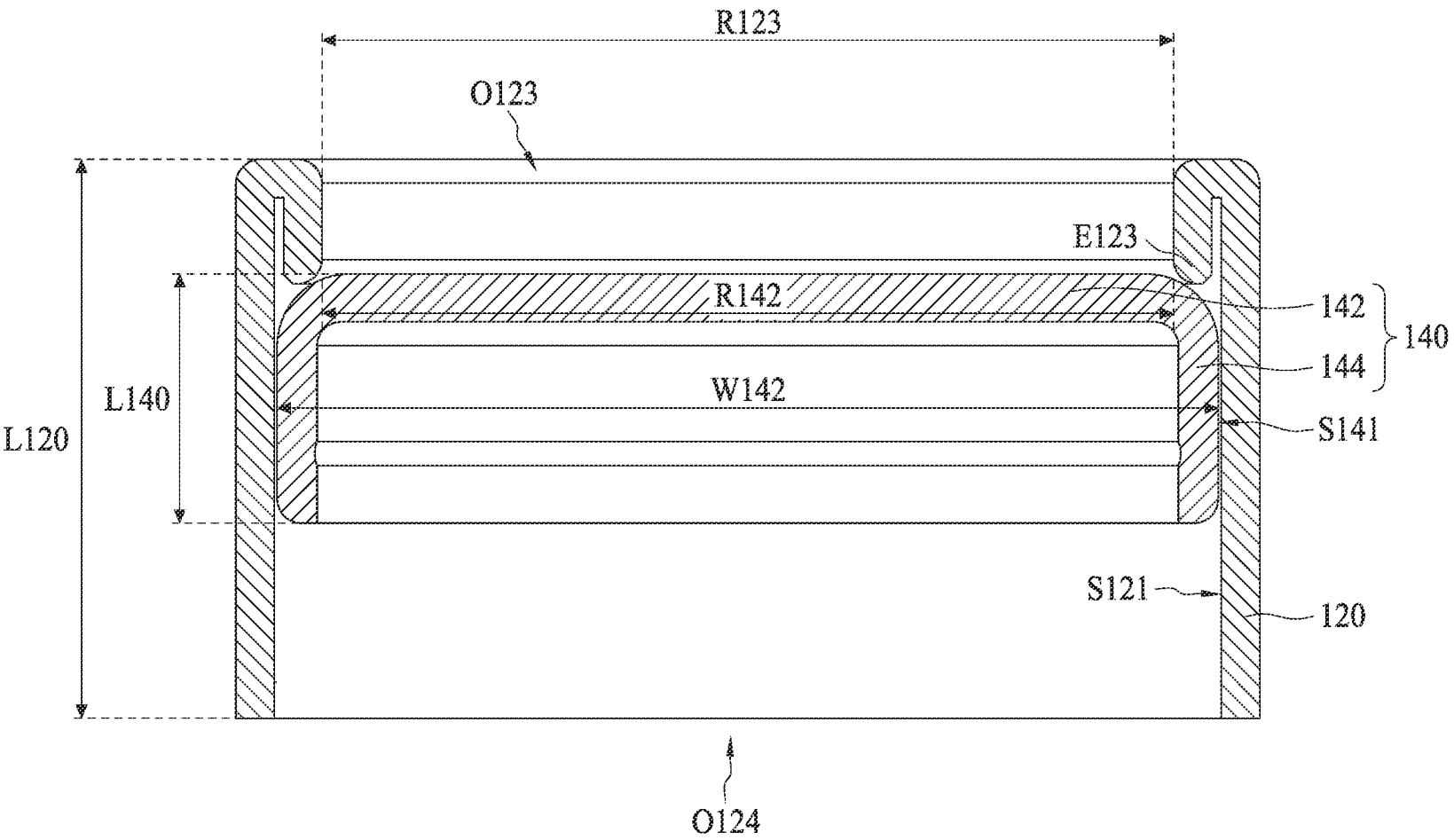
FIG. 2 is a cross-sectional perspective of the capping structure shown in FIG. 1 in accordance with some embodiments of the present disclosure.
Figure 3:
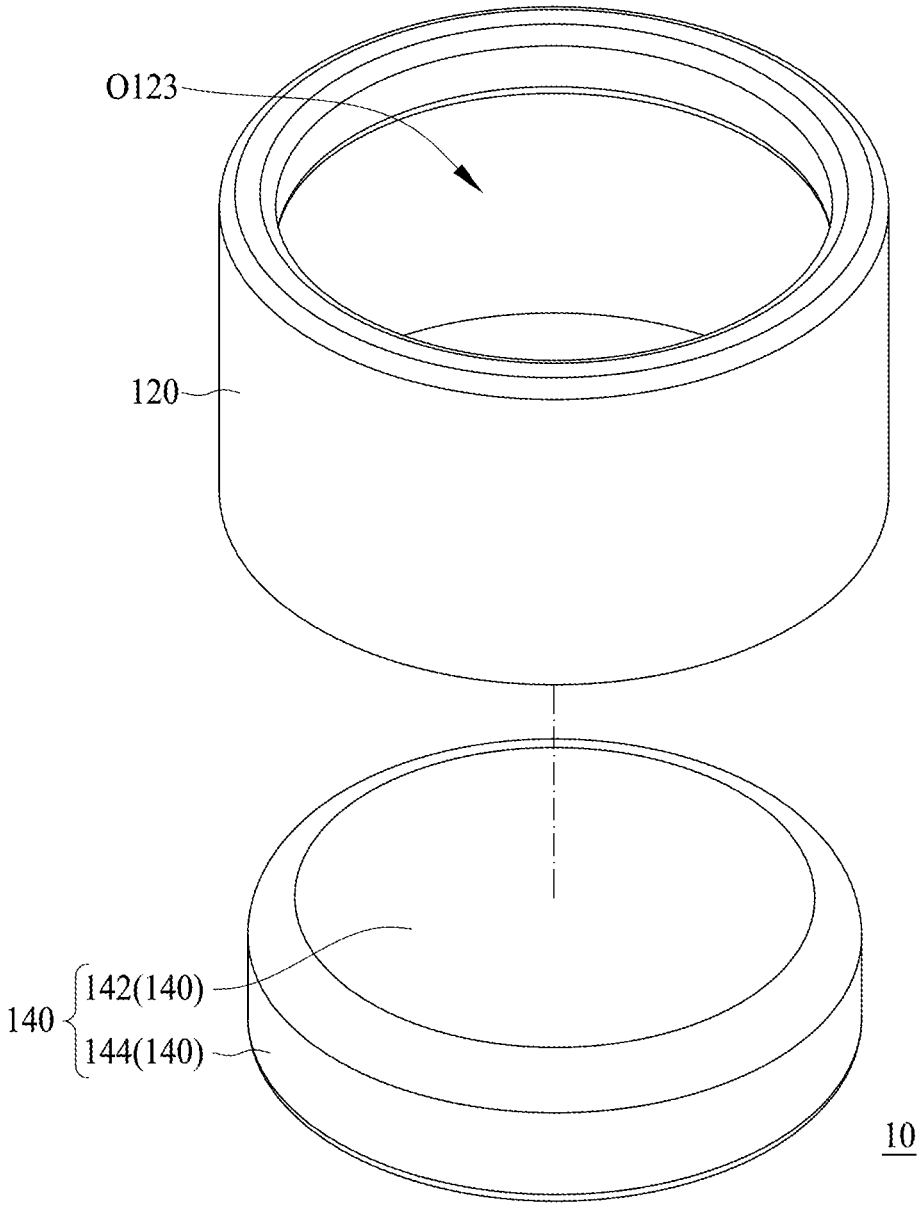
FIG. 3 is an exploded perspective of the capping structure shown in FIGS. 1 and 2 in accordance with some embodiments of the present disclosure.

FIG. 1 shows a capping structure 10 in accordance with some embodiments of the present disclosure. FIG. 2 is a cross-sectional perspective of the capping structure 10, and FIG. 3 is an exploded perspective of the capping structure 10.

In some embodiments, the capping structure 10 includes a tubular shell 120 and a cap window 140. The cap window is engaged with an inner sidewall S121 of the tubular shell 120 as shown in FIG. 2. The cap window 140 includes a cover 142 and a brace 144. The cover is disposed at an opening O123 of the tubular shell 120, and the brace 144 protrudes from the cover 142 and has at least a surface S141 being parallel to the inner sidewall S121 of the tubular shell 120.

In some embodiments of the present disclosure, the tubular shell 120 has a through hole, and the tubular shell can be in a circular or rounded configuration, e.g. a ring or a tube. In some embodiments, the tubular shell 120 has the opening O123 and an opening O124 opposite to the opening O123. A length L120 of the tubular shell 120 can be varied depending on different applications, wherein the length L120 is defined by a distance between the two opposite openings O123 and O124 of the tubular shell 120. In some embodiments of the present disclosure, the length L120 is greater than a length L140 of the cap window 140, wherein the length L140 is defined by a distance between an end of the brace 144 and the cover 142.

The cap window 140 is engaged with the tubular shell 120 by friction between the brace 144 and the inner sidewall S121 of the tubular shell 120. As the cap window 140 is plastic and can be formed to adapt to different sizes and shapes of the opening O123, a tightness of the engagement between the tubular shell 120 and the cap window can be adjusted. In addition, for secure engagement, the tubular shell 120 has a curved end E123 at the opening O123. In some embodiments, the curved end E123 is folded inwardly toward the inner sidewall S121 to form the opening O123 with a diameter R123, wherein the diameter R123 is smaller than a width W124 of the opening O124. The curved end E123 is substantially parallel to the inner sidewall S121.

A shape or a configuration of the brace 144 of the cap window 140 is not limited herein. In some embodiments, as shown in FIGS. 1, 2 and 3, the brace 144 is a circular sidewall protruding from the cover 142 and extending from the opening O123 toward the opening O124 along the inner sidewall S121 of the tubular shell 120. The brace 144 has a width along the cover 142 being equal to a circumference of the cover 142 in the embodiments. The shape and the configuration of the brace 144 conform with the opening O123. In addition, for the purpose of firm engagement and structural stability between the tubular shell 120 and the cap window 140, a ratio of the length L140 of the brace 144 to a diameter R142 of the cover 142 from a cross-sectional perspective is greater than 0.1.

In some embodiments, the cap window 140 is made of transparent material. In some embodiments of the present disclosure, the cap window 140 is made of at least one of polyamides (PA, or nylons), polycarbonate (PC), polyester (PES), polyethylene (PE), high-density polyethylene (HDPE), low-density polyethylene (LDPE), polyethylene terephthalate (PET), polypropylene (PP), polystyrene (PS), polyurethanes (PU), polyvinyl chloride (PVC), polyvinylidene chloride (PVDC), acrylonitrile butadiene styrene (ABS), polyethylene terephthalate modified glycol (PETG), polycyclohexane dimethyl terephthalate modified by glycol (PCTG), polylactide (PLA), crystallized polylactic acid (CPLA), suitable post-consumer recycled plastic (PCR) materials, and other suitable materials.

In some embodiments of the present disclosure, a material of the tubular shell 120 is different from that of the cap window 140, and the tubular shell 120 can be made of fibrous material. In some embodiments of the present disclosure, the tubular shell 120 may be made from at least one of wood fiber, cellulose fibers, wood pulp, straw pulp, hemp pulp, mash pulp, sugar cane pulp, bamboo pulp, and rag pulp. In some embodiments, the tubular shell 120 is made of coated paper for lower cost and flexible designing, and materials to be coated onto the paper are not limited herein.

Figure 4:
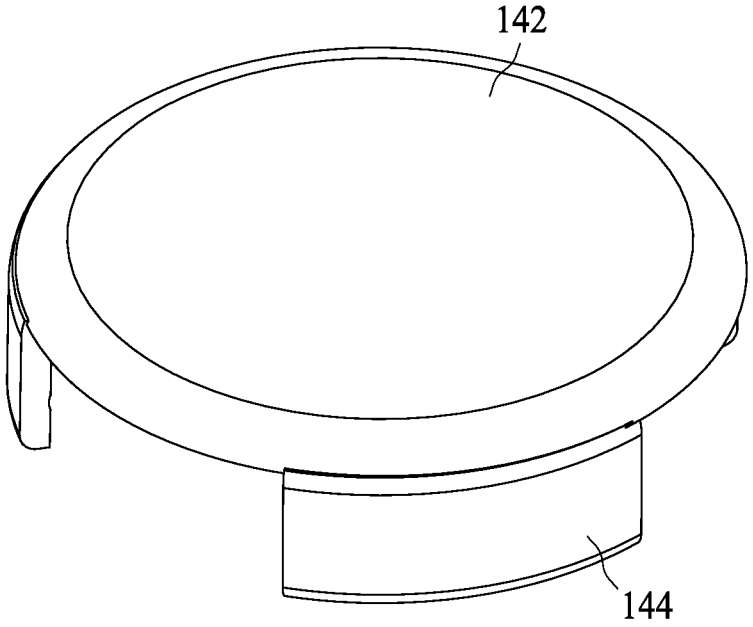
FIGS. 4 to 5 are 3D views from different directions of a cap window in accordance with some embodiments of the present disclosure.
Figure 5:
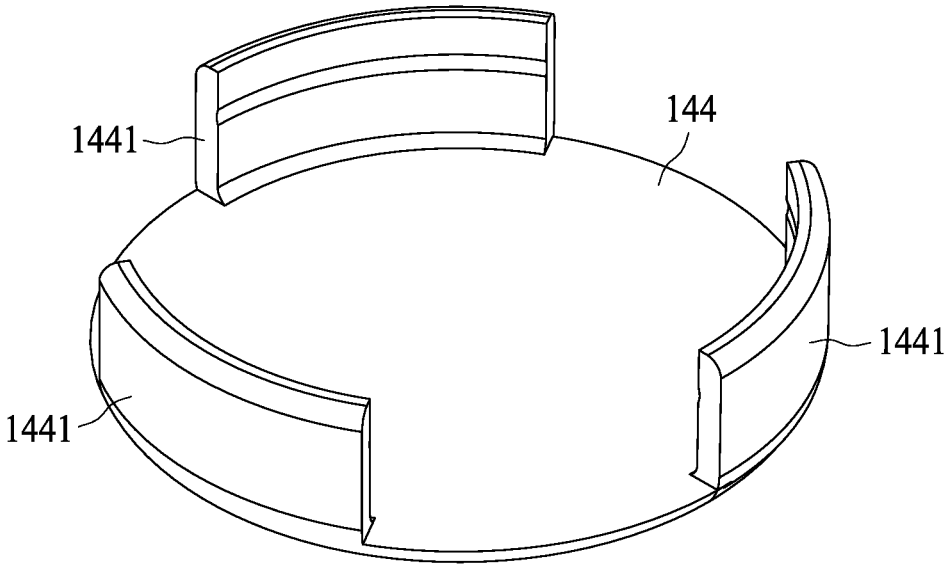
Figure 6:
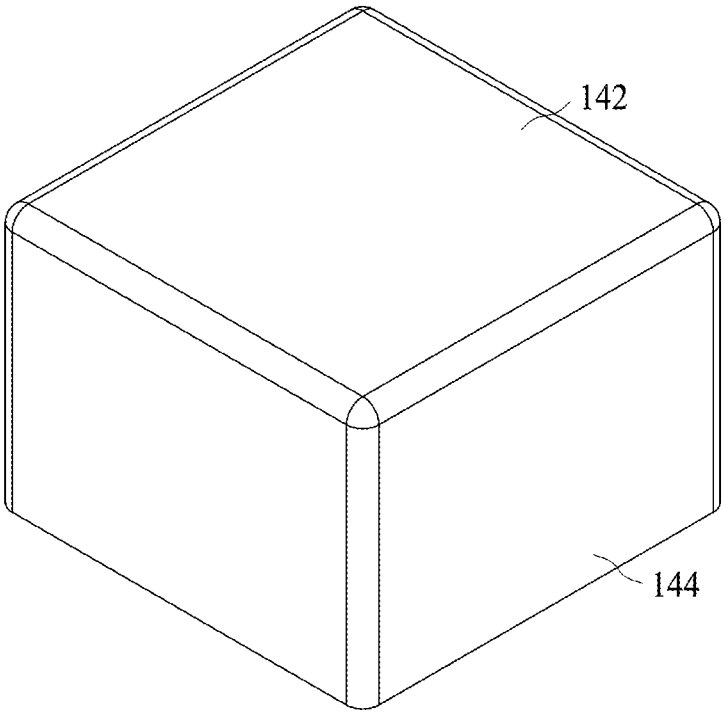
FIG. 6 is a 3D view of a cap window in accordance with some embodiments of the present disclosure.
Figure 7:
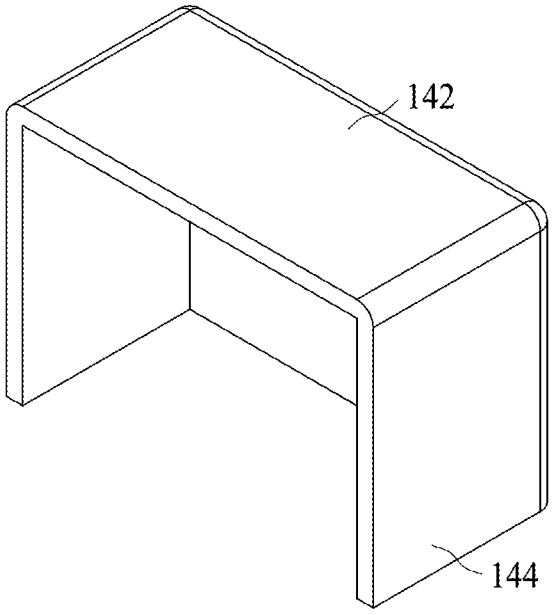
FIG. 7 is a cross-sectional perspective of a cap window in accordance with some embodiments of the present disclosure.
Figure 8:
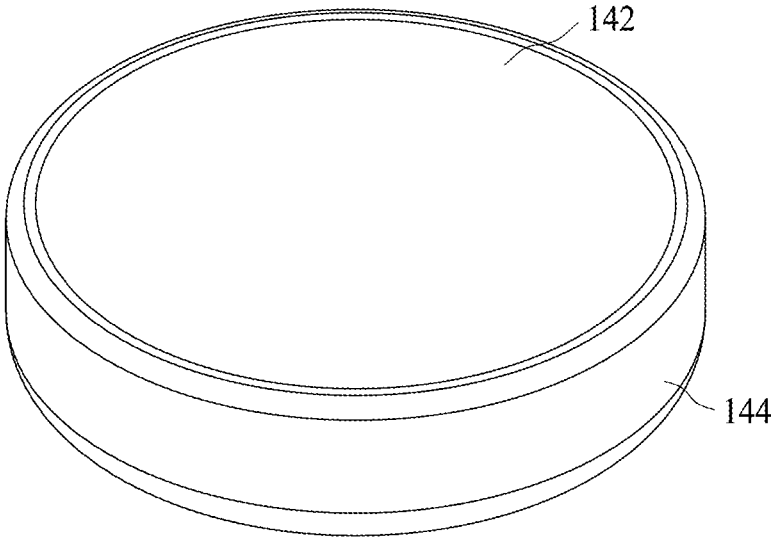
FIG. 8 is a 3D view of a cap window in accordance with some embodiments of the present disclosure.
Figure 9:
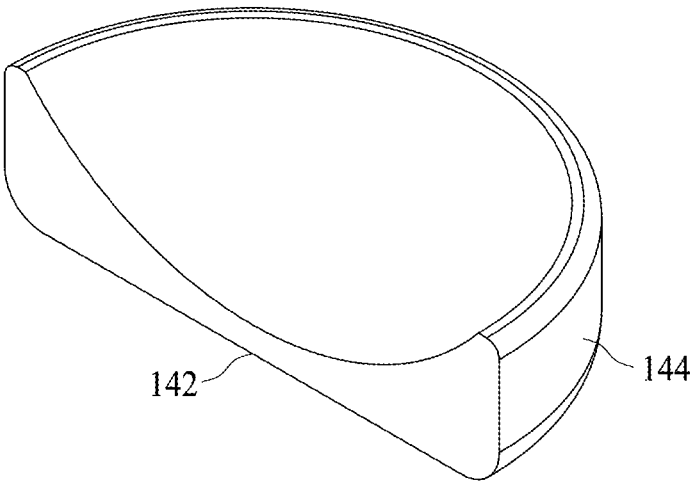
FIG. 9 is a cross-sectional perspective of a cap window in accordance with some embodiments of the present disclosure.
Figure 10:
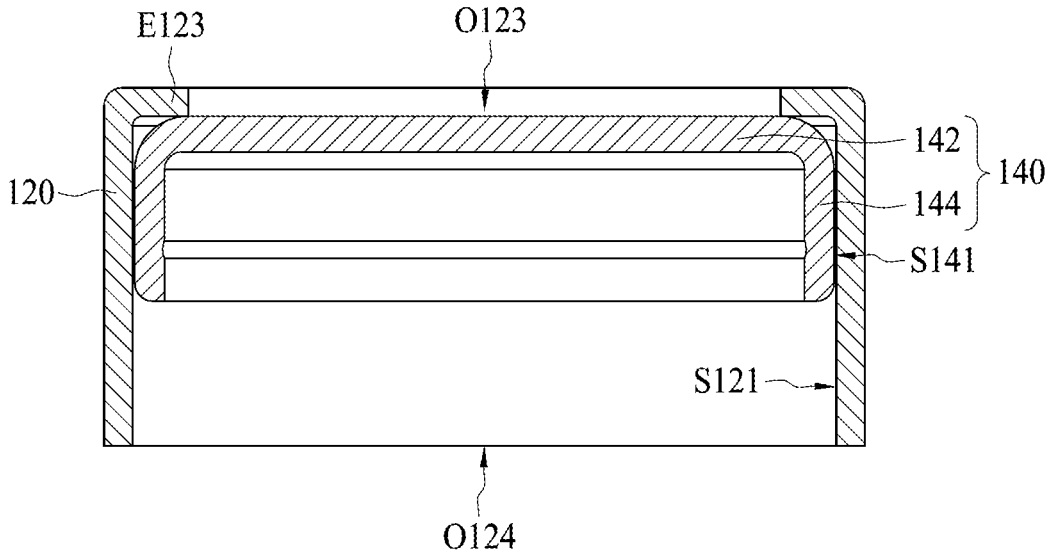
FIG. 10 is a cross-sectional perspective of a capping structure in accordance with some embodiments of the present disclosure.

In some embodiments, as shown in FIGS. 4 to 5, a cover 142 is substantially a circle, and the brace 144 includes three stands 1441, wherein FIG. 4 and FIG. 5 are an oblique top view and an oblique bottom view respectively. Each of the stands 1441 protrudes from a periphery of the cover 142 and has a radian of 60 degrees to a center of the cover 142. The stands 1441 are separated by a radian of 60 degrees to the center of the cover 142 along the periphery of the cover 142. Moreover, a shape or a configuration of the cover 142 is not limited herein. In some embodiments, as shown in FIGS. 6 to 7, a cover 142 is in a rectangular configuration, and the brace 144 protrudes from four sides of the cover 142, wherein FIG. 6 and FIG. 7 are an oblique top view and a cross-sectional view respectively. In the embodiments shown in FIGS. 6 to 7, an opening O123 of a tubular shell 120 correspondingly can be in a rectangular configuration as well. In some embodiments, as shown in FIGS. 8 to 9, the cover 142 is in a circular configuration, and the brace 144 protrudes from the cover 142 having a thickness that gradually increases from a center toward a peripheral area of the cover 142. FIG. 8 and FIG. 9 are an oblique top view and a cross-sectional view respectively. The cover 142 in the embodiments is a circle and the brace 144 has a recessed surface from a top view perspective. The above shapes and configurations of the brace 144, the cover 142 and the tubular shell 120 are provided for illustration but are not intended to limit the present disclosure.

Figure 12:
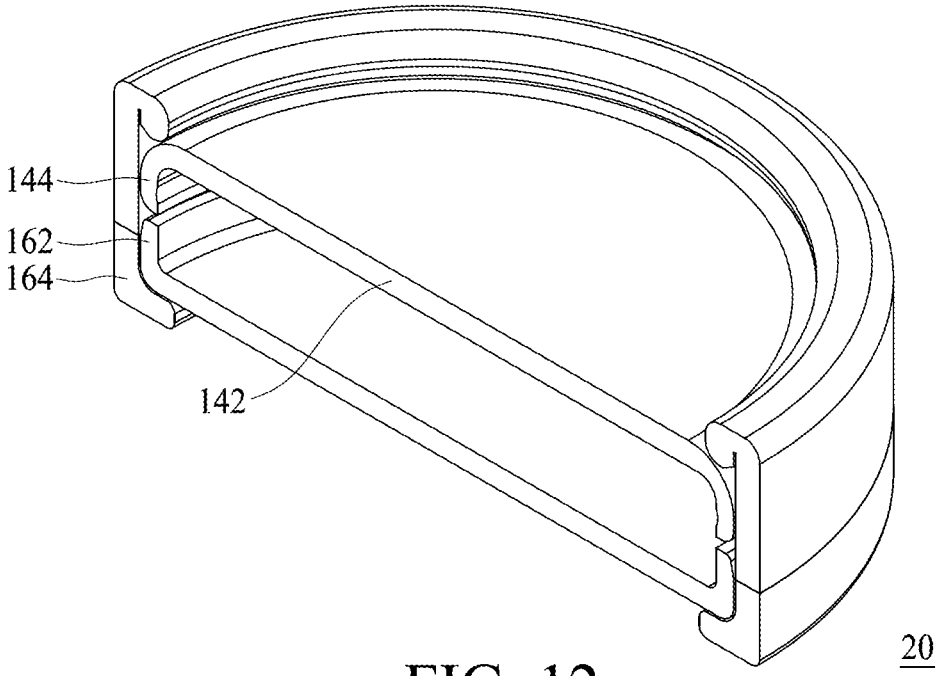
FIG. 12 is a cross-sectional perspective of the container shown in FIG. 11 in accordance with some embodiments of the present disclosure.

The curved end E123 of the tubular shell 120 can be adjusted to have a different degree with respect to the inner sidewall S121. In some embodiments, as shown in FIG. 12, the curved end E123 is folded inward to be substantially perpendicular to the inner sidewall S121 of the tubular shell 120. The curved end E123 of the tubular shell 120 functions as a stop to hold against the cap window 140 inside the tubular shell 120. In other words, the cover 142 of the cap window 140 is disposed at the opening O123 inside the tubular shell 120 and against the curved end E123 of the tubular shell 120. The curved end E123 and the brace 144 are at two opposite sides of the cover 142.

The capping structure 10 provided by the present disclosure can be applied to various kinds of containers. The cap window 140 and the tubular shell 120 are tightly engaged by friction between the inner sidewall S121 and the brace 144, and no usage of glue or adhesive medium is required. The capping structure provides a capping structure with less possibility of contamination to the object contained inside a container that the capping structure is assembled with. For instance, the capping structure provided by the present disclosure is able to be applied to a medicine container, a food container, a cosmetic container, or a toiletry container. Various materials can be used to form the cap window 140 and the tubular shell 120, and such variety of possible materials makes it possible to reduce material and manufacturing costs of the capping structure. Moreover, the transparent property of the capping structure of the present disclosure provides users with the convenience of being able to see contents inside a container without opening the container.

In some embodiments, the cap window 140 is made of PVC and the tubular shell 120 is made of coated paper to reduce material and manufacturing costs of the capping structure. The cap window 140 and the tubular shell 120 can be tightly engaged with each other and also provide sufficient hardness to protect the contents, e.g. lipstick or medicine tablets. Coated paper has advantages of low cost and also ability to be easily shaped or fixed with colored films to present different designation on a package of a product.

It should be noted that the capping structure 10 and the various possible configurations of different elements described above are for illustration of a general concept of the present disclosure, but are not intended to limit the present disclosure to specific embodiments. In addition, for the purpose of simplicity and clarity but not to limit the present disclosure, the same reference numerals are repeatedly used to refer to elements with same or similar functions or properties in various embodiments.

Figure 11:
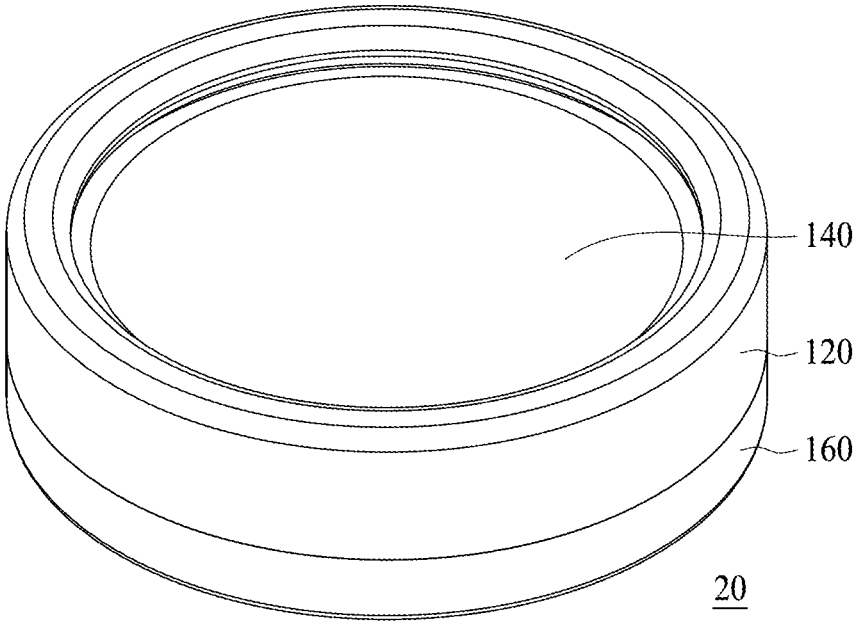
FIG. 11 is an assembled side view of a container in accordance with some embodiments of the present disclosure.
Figure 13:
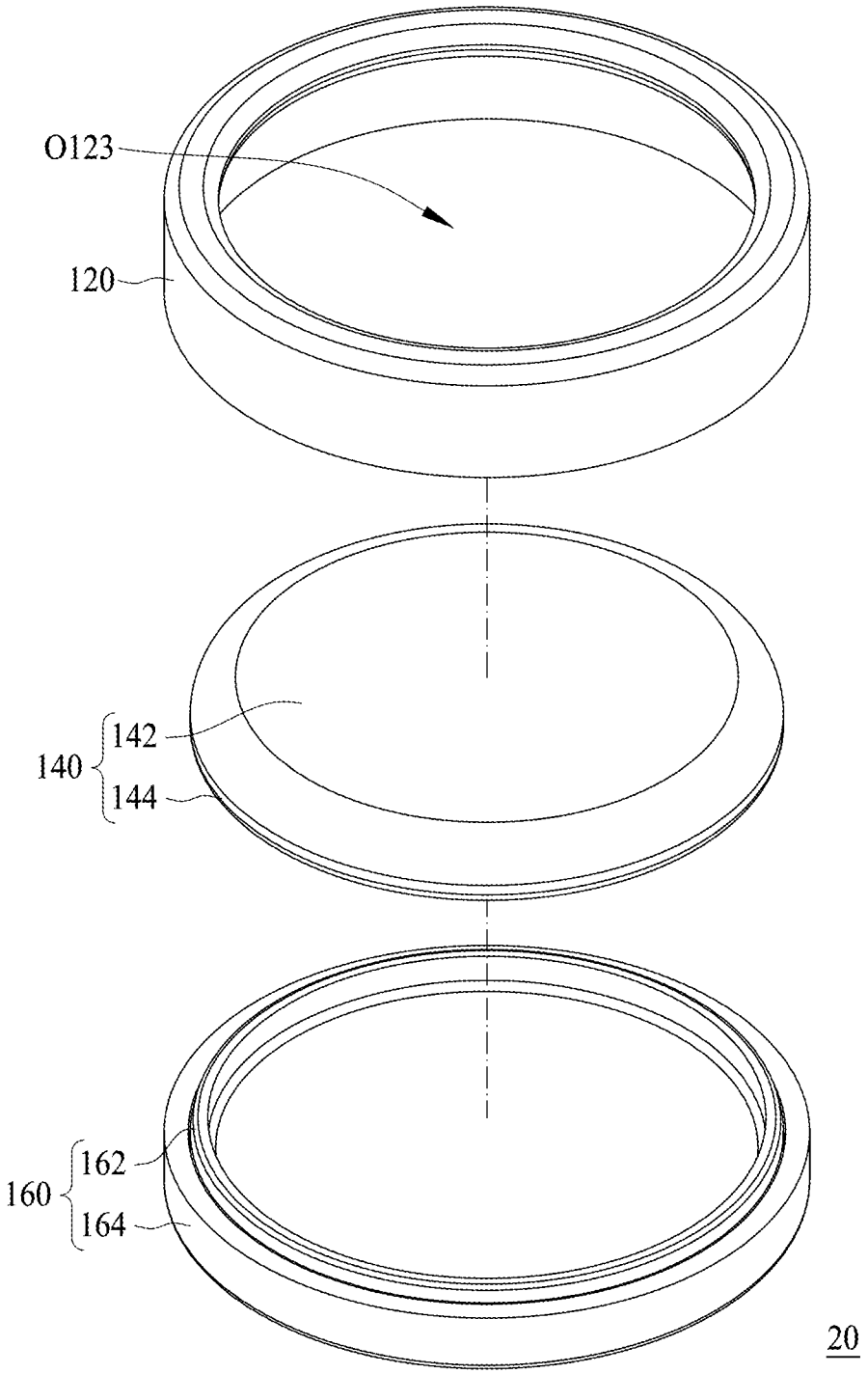
FIG. 13 is an exploded perspective of the container shown in FIGS. 11 and 12 in accordance with some embodiments of the present disclosure.
Figure 14:
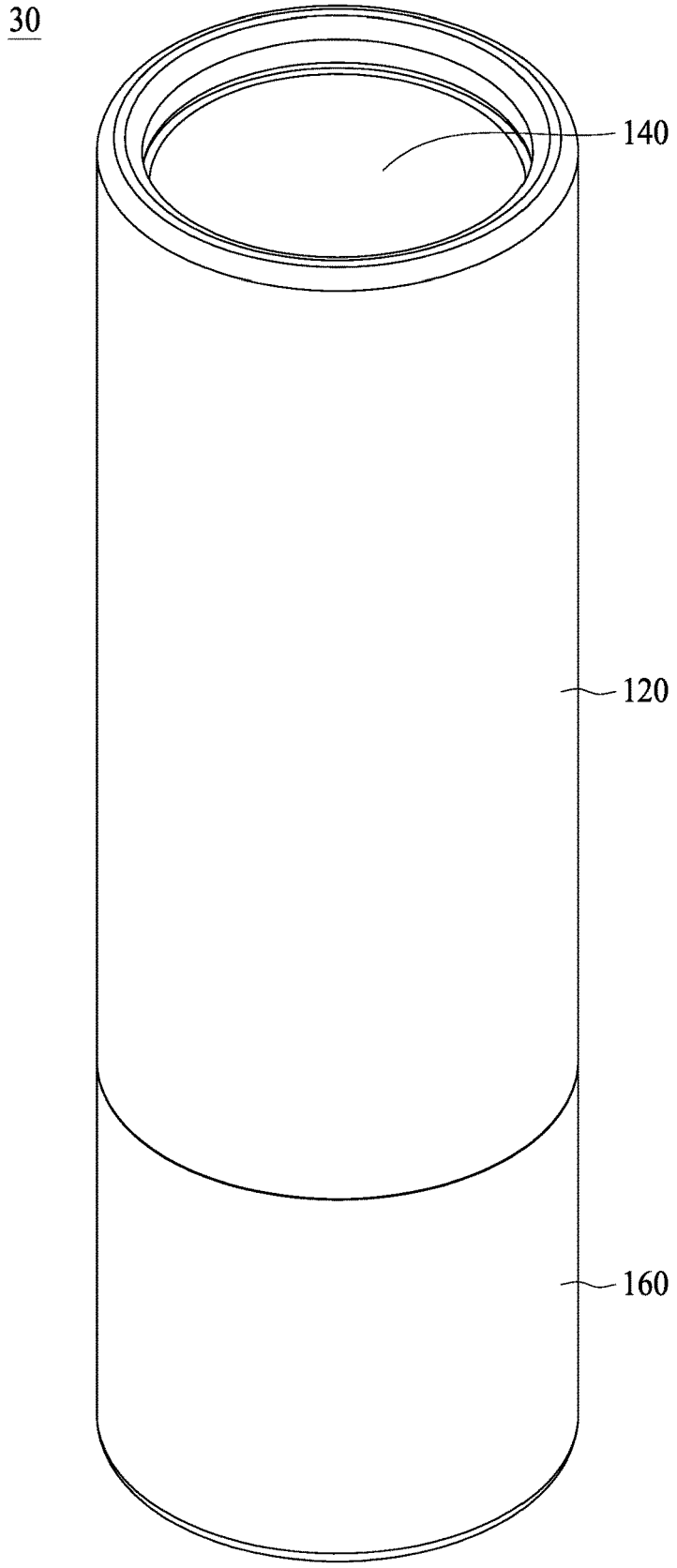
FIG. 14 is an assembled side view of a container in accordance with some embodiments of the present disclosure.
Figure 15:
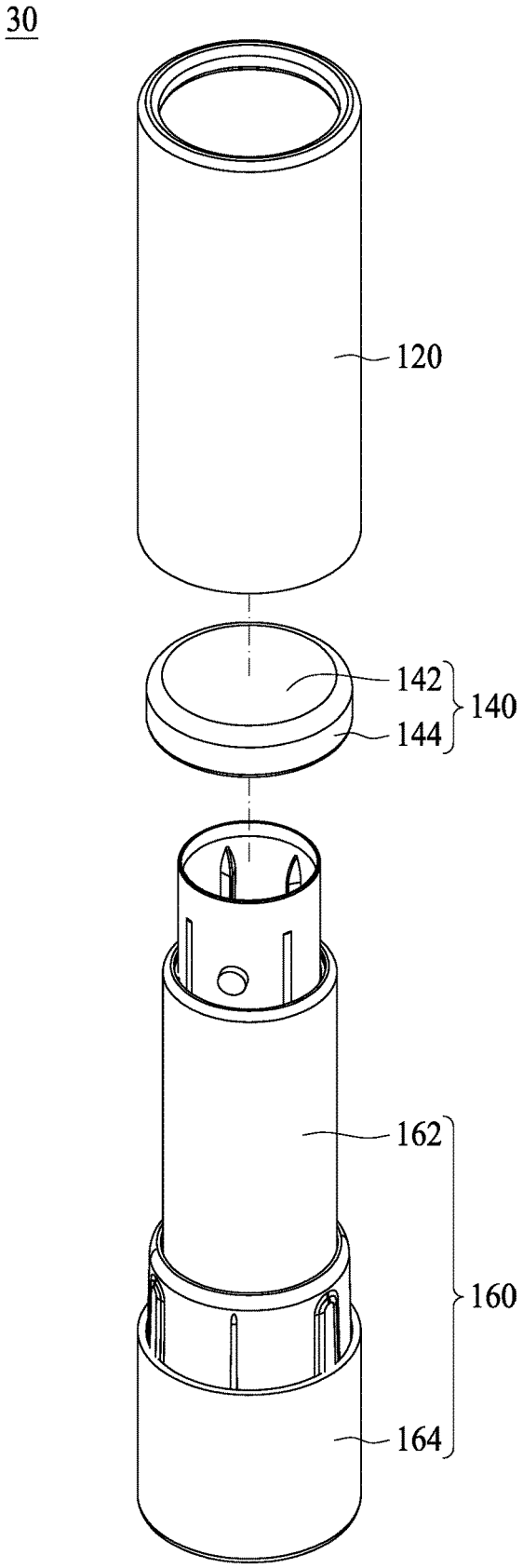
FIG. 15 is an exploded perspective of the container shown in FIG. 14 in accordance with some embodiments of the present disclosure.
Figure 16:
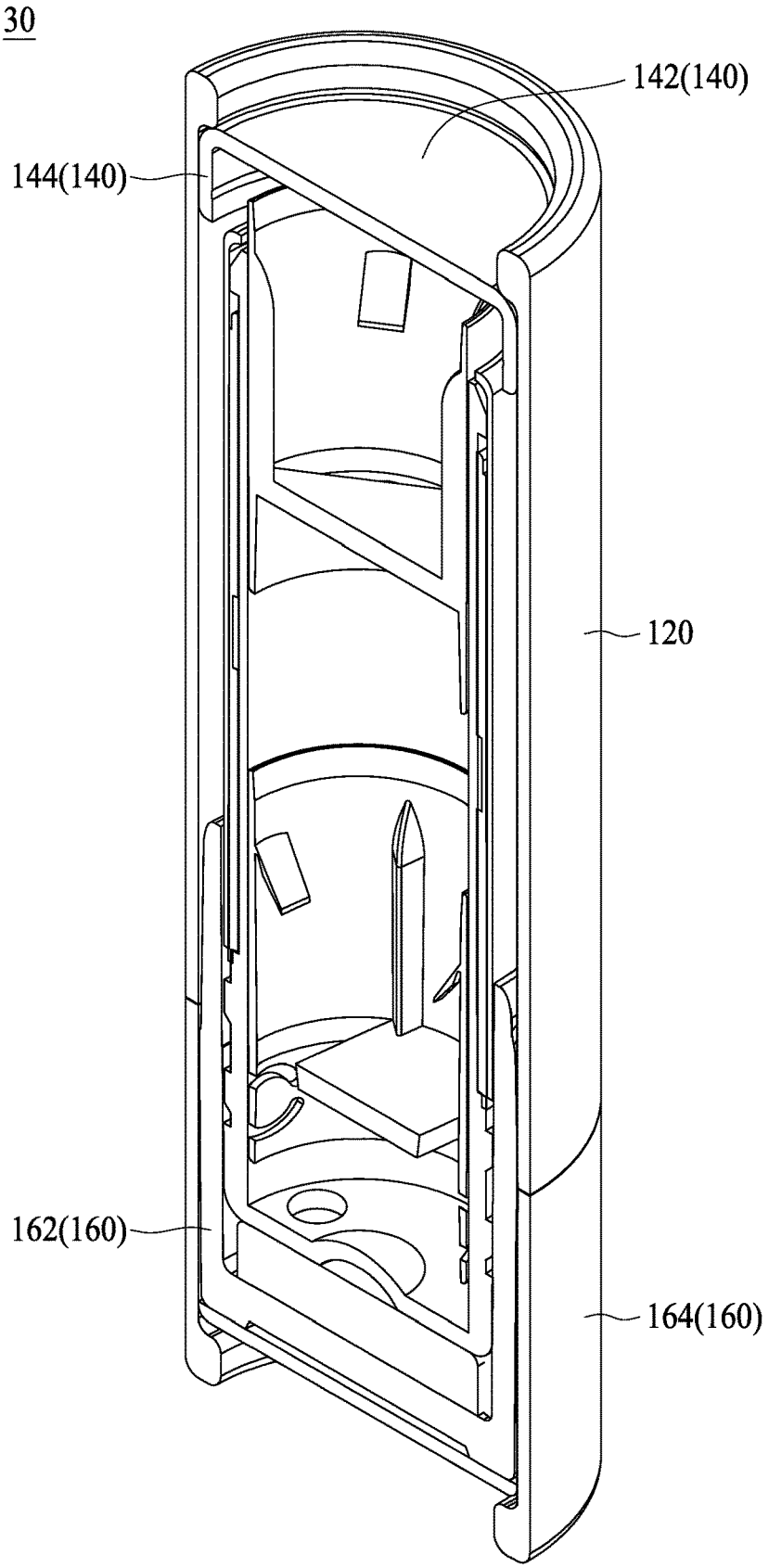
FIG. 16 is a cross-sectional perspective of the container shown in FIGS. 14 and 15 in accordance with some embodiments of the present disclosure.

FIGS. 11 to 13 show a container 20 in accordance with some embodiments of the present disclosure from different views. FIG. 14 is a side view of the assembled container 20, FIG. 15 is an exploded view of the container 20, and FIG. 16 is a cross-sectional view of the container 20. The container 20 includes a tubular shell 120, a cap window 140 and a holder 160, wherein the tubular shell 120 and the cap window 140 of the container 20 have similar or same properties or characteristics as illustrated above, and descriptions thereof are therefore not repeated herein. The holder 160 is engaged with an inner sidewall S121 of the tubular shell 120 from an opening O124. The holder 160 includes a body 162 and a base 164. The body 162 is connected to the base 164 and disposed inside the tubular shell 120 to engage with the inner sidewall S121 of the tubular shell 120 when the container 20 is assembled. In the embodiments shown in FIGS. 11 to 13, the body 162 and the base 164 are two separate formed elements. The body 162 and the base 164 can be made of same or different materials. In alternative embodiments, the body 162 and the base 164 are a one-piece structure. In some embodiments, the tubular shell 120 and the holder 160 engage with each other via spiral threads that are disposed on the inner sidewall S121 of the tubular shell 120 and correspondingly on an outer surface of the holder 160 (not shown). A type of engagement between the tubular shell 120 and the holder 160 is not limited herein.

FIGS. 14 to 16 show a container 30 for lipstick in accordance with some embodiments of the present disclosure from different perspective of views. FIG. 14 is a side view of the assembled container 30, FIG. 15 is an exploded view of the container 30, and FIG. 16 is a cross-sectional view of the container 30. The container 30 includes a tubular shell 120, a cap window 140 and a holder 160, wherein the tubular shell 120 and the cap window 140 of the container 20 have similar or same properties or characteristics as illustrated above in the capping structure 10 and the container 20, and descriptions thereof are therefore not repeated herein. The holder 160 is engaged with an inner sidewall S121 of the tubular shell 120 from an opening O124. The holder 160 includes a body 162 and a base 164. The body 162 is connected to the base 164 and disposed inside the tubular shell 120 to engage with the inner sidewall S121 of the tubular shell 120 when the container 20 is assembled. The body 162 and the base 164 are rotated in opposite directions relative to each other to extend or retract the lipstick in the container 30. Conventional technologies can be applied to the body 162, and detailed description of structure of the body 162 is omitted herein. In the embodiments shown in FIGS. 14 to 16, the body 162 and the base 164 are two separate formed elements. The body 162 and the base 164 can be made of same or different materials. For instance, the body 162 can be made of plastic material and the base 164 can be made of coated paper. In alternative embodiments, the body 162 and the base 164 are a one-piece structure. In some embodiments, the tubular shell 120 and the holder 160 engage with each other via spiral threads that are disposed on the inner sidewall S121 of the tubular shell 120 and correspondingly on an outer surface of the holder 160 (not shown). A type of engagement between the tubular shell 120 and the holder 160 is not limited herein.

In conclusion, with the disposition of the cap window 140, the capping structure can be assembled for presenting a desired function. In addition, with the disposition of the brace 144 of the cap window 140 and the inner sidewall S121 of the tubular shell 120, the container can be assembled with limited containing factors and for better preservation of the content in the container.

One aspect of the present disclosure provides a capping structure comprising a tubular shell and a cap window, which is engaged with an inner sidewall of the tubular shell. The cap window is transparent and comprises a cover and a brace, the cover is disposed at a first opening of the tubular shell, and the brace protrudes from the cover and has at least a surface being parallel to the inner sidewall of the tubular shell.

One aspect of the present disclosure provides a container comprising a tubular shell, a holder, and a cap window. The tubular shell has a first opening and a second opening, and the first opening is opposite to the second opening. The holder is engaged with an inner sidewall of the tubular shell from the second opening. The cap window is engaged with the inner sidewall at the first opening of the tubular shell. The cap window is transparent and comprises a cover and a brace, the cover is disposed at a first opening of the tubular shell, and the brace protrudes from the cover and has at least a surface being parallel to the inner sidewall of the tubular shell.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A capping structure, comprising:

a tubular shell; and a cap window, engaged with an inner sidewall of the tubular shell, the cap window being transparent and comprising:

a cover, disposed at a first opening of the tubular shell; and a brace, protruding from the cover and having at least a surface being parallel to the inner sidewall of the tubular shell, wherein the tubular shell has a curved end folded inwardly toward the inner sidewall of the tubular shell, and the curved end is substantially parallel to the inner sidewall.

2. The capping structure of claim 1, wherein the cap window is engaged with the tubular shell by friction between the brace of the cap window and the inner sidewall of the tubular shell.

3. The capping structure of claim 1, wherein the tubular shell is made of fibrous material.

4. The capping structure of claim 1, wherein material of the tubular shell includes at least one of paper, wood fiber, cellulose fibers, wood pulp, straw pulp, hemp pulp, mash pulp, sugar cane pulp, bamboo pulp, and rag pulp.

5. The capping structure of claim 1, wherein the sidewall has a circular configuration extending from the first opening toward a second opening of the tubular shell and along the inner sidewall of the tubular shell, and the second opening is opposite to the first opening.

6. The capping structure of claim 5, wherein the curved end is folded inward to form the first opening with a radius smaller than a radius of the second opening.

7. The capping structure of claim 6, wherein the cover of the cap window is disposed at the first opening inside the tubular shell and against the curved end of the tubular shell.

8. The capping structure of claim 1, wherein the tubular shell has the curved end at the first opening of the tubular shell.

9. The capping structure of claim 1, wherein the brace of the cap window has a first length along the inner sidewall of the tubular shell, the inner sidewall of the tubular shell has a second length parallel to the first length, and the second length is greater than the first length.

10. The capping structure of claim 1, wherein a ratio of a length of the brace to a width of the cover from a cross-section perspective is greater than 0.1.

11. A container, comprising:

a tubular shell, having a first opening and a second opening, the first opening is opposite to the second opening;

a holder, engaged with an inner sidewall of the tubular shell from the second opening; and a cap window, engaged with the inner sidewall at the first opening of the tubular shell, the cap window being transparent and comprising:

a cover, disposed at the first opening of the tubular shell; and a brace, protruding from the cover and having at least a surface being parallel to the inner sidewall of the tubular shell, wherein the tubular shell has a curved end folded inwardly toward the inner sidewall of the tubular shell, and the curved end is substantially parallel to the inner sidewall.

12. The container of claim 11, wherein the holder comprises:

a base, disposed outside the tubular shell; and a body, connected to the base and disposed inside the tubular shell.

13. The container of claim 12, wherein the container is a lipstick container, and the base and the body are rotated in opposite directions relative to each other to extend or retract a lipstick.

14. The container of claim 11, wherein the cap window is engaged with the tubular shell by friction between the brace of the cap window and the inner sidewall of the tubular shell.

15. The container of claim 11, wherein the tubular shell is made of paper.

16. The container of claim 11, wherein the cap window is made from at least one of polyamides (PA, or nylons), polycarbonate (PC), polyester (PES), polyethylene (PE), high-density polyethylene (HDPE), low-density polyethylene (LDPE), polyethylene terephthalate (PET), polypropylene (PP), polystyrene (PS), polyurethanes (PU), polyvinyl chloride (PVC), polyvinylidene chloride (PVDC), polyethylene terephthalate modified glycol (PETG), polycyclohexane dimethyl terephthalate modified by glycol (PCTG), polylactide (PLA), crystallized polylactic acid (CPLA), post-consumer recycled plastic (PCR), and acrylonitrile butadiene styrene (ABS).

17. The container of claim 11, wherein the sidewall has a circular configuration protruding from a peripheral region of the cover extending from the first opening toward the second opening of the tubular shell and along the inner sidewall of the tubular shell.

18. The container of claim 17, wherein the cover of the cap window is disposed at the first opening inside the tubular shell and against the curved end of the tubular shell.

19. The container of claim 11, wherein an end of the tubular shell is folded toward the inner sidewall to form the first opening.

20. The container of claim 11, wherein a radius of the first opening is smaller than that of the second opening.

* * * * *